United States Patent [19]

Tosaka et al.

[11] Patent Number: 4,709,557

[45] Date of Patent: Dec. 1, 1987

[54] METHOD AND SYSTEM FOR COOLING STRIP

[75] Inventors: Akio Tosaka; Koichi Hashiguchi; Masahiko Morita; Shinobu Okano, all of Chiba, Japan

[73] Assignee: Kawasaki Steel Corporation, Hyogo, Japan

[21] Appl. No.: 10,496

[22] Filed: Feb. 3, 1987

[30] Foreign Application Priority Data

| | | | |
|---|---|---|---|
| Feb. 4, 1986 | [JP] | Japan | 61-21102 |
| Feb. 4, 1986 | [JP] | Japan | 61-21103 |
| Nov. 7, 1986 | [JP] | Japan | 61-17033[U] |
| Nov. 7, 1986 | [JP] | Japan | 61-170334[U] |

[51] Int. Cl.[4] ..... F25D 17/02

[52] U.S. Cl. ..... 62/373; 239/455; 239/568; 239/597

[58] Field of Search ..... 62/63, 64, 373, 374, 62/375; 239/455, 568, 597

[56] References Cited

U.S. PATENT DOCUMENTS

| | | | |
|---|---|---|---|
| 3,927,162 | 12/1975 | Statler, Jr. | 239/597 |
| 4,306,684 | 12/1981 | Peterson | 239/597 |
| 4,568,369 | 2/1986 | Destruhaut | 62/373 |
| 4,570,453 | 2/1986 | Kamio et al. | 62/375 |

OTHER PUBLICATIONS

Coble, J. F. et al; "Nozzles for Adhesive Dispensing machine", Tech. Dig. No. 26, 4/1972 Western Electric.

*Primary Examiner*—Ronald C. Capossela
*Attorney, Agent, or Firm*—Austin R. Miller

[57] ABSTRACT

A laminar flow cooling system employs a laminar flow nozzle comprising a pair of plate members defining slit through which cooling water flows to form a cooling water screen. One of the plate members of the laminar nozzle is deformable at least in a direction perpendicular to the cooling water flow direction to adjust the path area in the nozzle. At least one of the plate member is preferably responsive to the cooling water pressure to cause variation of the path area for adjusting the cooling water path area.

45 Claims, 32 Drawing Figures

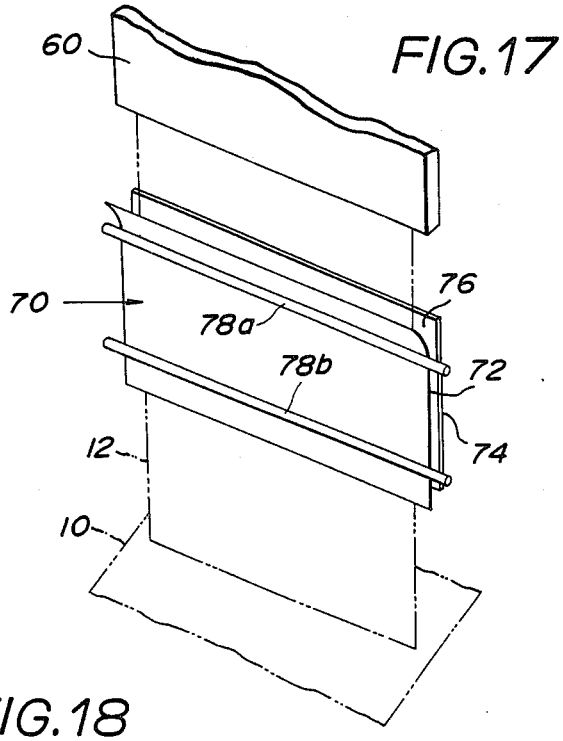
FIG.17
FIG.18
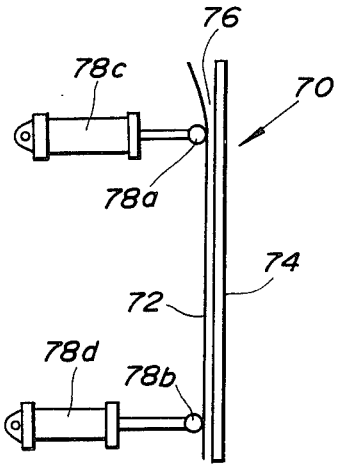
FIG.19
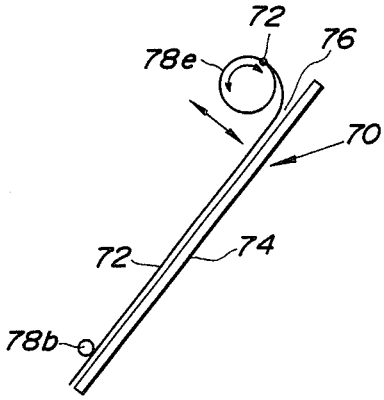

(A)

(B)

METHOD AND SYSTEM FOR COOLING STRIP

BACKGROUND OF THE INVENTION

1. Field of the Invention

The present invention relates generally to a method and system for cooling strip, such as steel strip and so forth. More specifically, the invention relates to a novel and useful laminar flow cooling system for establishing laminar flow of cooling fluid for cooling strips with substantially uniform cooling rate over the over all width of the strips. Further particularly, the invention relates to a laminar flow cooling system which is adjustably of flow rate of a cooling fluid as a cooling medium for adjusting cooling efficiency.

2. Description of the Background Art

Laminar flow cooling systems are employed in hot strip mill lines for cooling steel strip, for example. Such cooling system is arranged between a finishing mill and a take-up roll for cooling strip fed along a run-out table. In such laminar flow cooling system, water is generally used as cooling medium and discharged toward the strip in a form of a plurality of bars-form laminar flow aligned in a direction of the width of the strip, or in a form of slit laminar flow extending in the direction of the width of the strip so as to cover overall width of the strip. Such laminar flow cooling systems have higher cooling efficiency than a spray-cooling system, in which high pressure water is sprayed toward the strip; for the former generates higher heat transfer coefficient than the latter. Therefore, such laminar flow cooling systems are known to allow higher speed production of steel strip in the hot strip mill lines. Furthermore, particularly in the case of the slit laminar flow of the cooling water, highly uniform temperature distribution in the width of the strip can be achieved because of uniform cooling efficiency over the overall width of the strip.

One type of the laminar flow cooling systems is known as a "pipe-laminar flow cooling system". In this system, water-bar form of laminar flow is formed by pipe laminar flow nozzles. The other type of laminar flow cooling system is known as a "slit laminar flow cooling system". This system employs a slit laminar flow nozzles for establishing the slit laminar flow of the cooling water. The pipe laminar flow cooling system has been disclosed in the Japanese Utility Model Second (examined) Publication (Jikko) No. Showa 56-41848, for example. On the other hand, slit laminar flow cooling system has been disclosed in the Japanese Patent First (unexamined) Publication (Tokkai) No. Showa 58-77710 and the Japanese Utility Model First Publication (Jikkai) No. Showa 57-170812. In the known laminar flow cooling systems, it is well known that slit laminar flow cooling systems will have a cooling efficiency at the magnitude of about 1.5 times to 2 times higher than the pipe laminar flow cooling systems.

However, the slit laminar flow cooling system has the following drawbacks.

First of all, the slit laminar flow cooling systems are complicated in construction in comparison with that of the pipe laminar flow cooling system. Secondly and more importantly, the conventional slit laminar flow cooling system have a fixed cooling water flow area to limit range of cooling water flow rate variation. Namely, when relatively low cooling efficiency is desired, it becomes difficult to sufficiently reduce the cooling water flow rate without causing breaking of the slit laminar flow. On the other hand, when substantially high cooling efficiency is required, the flow velocity of the cooling water becomes excessive to cause sprushing of the cooling water on the strip to lower the cooling efficiency. Therefore, it is well known that the slit laminar flow cooling system is only effective within a limited range of cooling efficiency. Furthermore, in order to form the slit laminar flow of the cooling water by means of the slit laminar flow nozzle, the slitted gap has to be narrow enough, e.g. about 20 to 30 mm. This can allow accumulation of foreign matters, such as fur. Accumulation of the foreign matter will cause variation of the cooling water path area and thus will cause variation of the cooling efficiency. Therefore, it is required for the conventional slit laminar flow nozzle to be regularly cleaned.

In order to allow a wider range adjustment of the cooling water flow rate in the laminar flow established by means of the slit laminar flow cooling system, there have been proposed improved slit laminar flow cooling systems with adjustable slit sizes. Such slit laminar flow cooling system have been disclosed in the Japanese Patent First Publication No. Showa 57-103728 and the Japanese Utility Model First Publication No. Showa 59-171761, for example. According to the disclosures of these publications, one of a pair of flow guide plates is movable with respect to the other flow guide plate in order to adjust the gap between the fluid guide plates and whereby adjusts the cooling water path area. Though such systems allow wider range adjustment of the cooling water flow amount and/or cooling water flow velocity, they require mechanisms for movably supporting the movable flow guide plates. This makes the structure of the cooling systems more complicate. Furthermore, such systems require relatively complicated and troublesome manual adjustment of the gaps between the flow guide plates.

There have also been proposed other type of laminar flow cooling systems which allow adjustment of the cooling water flow rate for varying cooling efficiency for controlling grain size of steel, material microstructure of the steel strip and so forth to control the quality of the strip. Such laminar flow cooling systems have been disclosed in the Japanese Patent First Publications Nos. Showa 51-28560, 54-57414, 55-88921 and 59-59011, for example. In the disclosures of the Japanese Patent First Publications Nos. Showa 51-28560, 54-57414 and 55-88921, flow control valves are provided in cooling water supply lines for supplying cooling water to the laminar flow nozzles. On the other hand, in the disclosure of the Japanese Patent First Publication No. Showa 59-50911, the laminar flow cooling system is provided with a flow control valve in the cooling water supply line and a flow-blocking plate for interrupting the flow from the laminar flow nozzle for providing an ON or OFF control of water reaching the strip surface. These systems may allow some flow control for the cooling water according to the desired cooling efficiency. However, due to mechanical lag-time in the flow control valve and due to lag in variation of the cooling water flow rate in the cooling water supply lines, responseability to water amount control is not satisfactorily high. Furthermore, even by the latter mentioned system, as disclosed in the Japanese Patent First Publication No. Showa 59-50911, control of the cooling water flow is limited to ON or OFF. Therefore, although flow rate of the cooling water is variable according to the disclosed system, control response is slow in all but the ON/OFF control functions. Also, variable flow rate adjustments can only be made through a relatively small range.

SUMMARY OF THE INVENTION

Therefore, it is an object of the present invention to provide a laminar flow cooling system for strips, which has simplified construction and has capability of substantially wide range adjustment of cooling efficiency of the strip.

Another object of the invention is to provide a laminar flow cooling system which can precisely control a cooling fluid flow amount with substantially high responseability.

A further object of the present invention is to provide a laminar flow cooling system which can adjust cooling fluid path area of a laminar flow nozzle in automatic manner.

In order to accomplish the aforementioned and other objects, a laminar flow cooling system, according to the present invention, employs a laminar flow nozzle comprising a pair of plate members defining slit through which cooling fluid flows to form a cooling fluid screen. One of the plate members of the laminar nozzle is deformable at least in a direction perpendicular to the cooling fluid flow direction to adjust the path area in the nozzle. The deformable plate member is preferably responsive to the cooling fluid pressure to cause variation of the path area for adjusting the cooling fluid path area.

In the preferred construction, another laminar nozzle or nozzles are provided upstream of the aforementioned laminar nozzle with the deformable plate member for supplying laminar flow cooling fluid.

It may also be possible to provide a flow control means which is interposed between the laminar nozzles for adjusting cooling fluid amount supplied to the downstream nozzle. In the preferred construction, the flow control means comprises a shutter plate with an peripheral end formed with a plurality of cut-outs for allowing fluid flow therethrough. The plate of the flow control means is movable with respect to the cooling fluid path between the nozzles between completely closing position for shutting off the cooling fluid supply to the downstream nozzle and completely open position to allow full amount of cooling fluid supply to the downstream nozzle. At the intermediate position between the fully closed position and fully open position, the cooling fluid supply amount is limited by passing the laminar flow fluid from the upstream nozzle only through the cut-outs.

According to one aspect of the invention, a strip cooling system comprises a laminar flow nozzle constituted of a pair of first and second plates arranged in side-by-side relationship to each other for defining therebetween a fluid path of a cooling fluid for establishing a slit laminar flow substantially perpendicular to a strip path, through which the strip is transferred, the first plate being displaceable relative to the second plate for varying the path area of the fluid path, a cooling fluid supply means for supplying controlled amount of cooling fluid to flow through the fluid path, and the first plate being responsive to fluid pressure within the fluid path, for causing displacement relative to the second plate at a magnitude corresponding to the fluid pressure.

Preferably, the first plate is formed of a deformable material for causing deformtion corresponding the fluid pressure in the fluid path, and the cooing supply means comprises a laminar flow nozzle for supplying the cooling fluid at substantially uniform flow rate distribution over substantially overall width of the fluid path.

The first and second plates are arranged to define a minimum path area of the fluid path at an initial position, and the first plate is displaced away from the second plate at a magnitude corresponding the the fluid pressure in the fluid path for widening the path area. By providing the variable flow area for the fluid path through the laminar flow nozzle, substantially wide range of adjustment of the cooling fluid flow rate becomes possible without causing breaking of the laminar flow.

The strip cooling system may further comprise a flow blocking means interposed between the cooling fluid supply means and the laminar flow nozzle for limiting cooling fluid path between the cooling fluid supply means and the laminar flow nozzle for adjusting cooling fluid supply rate for the laminar flow nozzle. The flow blocking means is movable for adjusting flow blocking magnitude corresponding to the width of the strip to be cooled. The flow blocking means comprises a pair of flow blocking members horizontally movable along the upper edge of the laminar flow nozzle for adjusting flow blocking magnitude. Flow blocking for adjusting cooling fluid supply amount relative to the width of the strip may achieve uniform distribution of the cooling fluid flow rate substantially overall width of the strip.

In the alternative, the strip cooling system may further comprises a flow control means interposed between the cooling fluid supply means and the laminar flow nozzle for adjusting supply amount of the cooling fluid from the cooling water supply means to the laminar flow nozzle. The flow control means is horizontally movable in a direction substantially parallel to the feed direction of the strip for adjusting limiting magnitude of cooling fluid supply according to desired cooling efficiency. The flow control means intercepts part of cooling water supplied from the cooling water supply means for adjusting cooling water supply amount for the laminar flow nozzle. In the preferred construction, the flow control means linearly increase and decrease intercepting amount of cooling water for linearly adjusting cooling fluid supply amount for the laminar flow nozzle. In the alternative construction, the flow control means varies intercepting amount of the cooling fluid in stepwise fashion for adjusting cooling fluid supply amount in stepwise fashion.

The flow control means according to the invention operates in mechanical operation and directly controls cooling fluid supply amount of the cooling fluid for the laminar flow nozzle. Therefore, responsability of flow rate adjustment becomes high enough to satisfactorily apply the cooling system for hot strip mill line.

On the other hand, the strip cooling system further comprises means for biasing the first plate toward the second plate with a given force for limiting displacement of the first plate relative to the second plate in response to the fluid pressure within the fluid path. The biasing means comprises a bar member extending substantially parallel to the first plate and an actuator depressing the bar member toward the first plate at a controlled pressure. On the other hand, the first plate is made of a resiliently deformable materal and is fixed to a stationary member at the top edge thereof for creating resilient force in the first plate per se for resiliently biasing the same toward the second plate for restricting displacement of the first plate relative to the second plate. Restriction of the displacement of the first plate may achive uniform distribution of the flow rate of the cooling fluid in the laminar flow even when substatially large flow rate of cooling fluid is required for obtaining high cooling efficiency.

In the preferred construction, the laminar flow nozzle is arranged oblique to a vertical plane, along which the cooling fluid is supplied from the cooling fluid supply means. Preferably, the laminar flow nozzle is cooperated with means for adjusting tilt angle of the laminar flow nozzle relative to the vertical plane. The tilted laminar flow nozzle may discharge the cooling fluid to establish laminar for with flow directionality of the cooling fluid on the strip. This helps to quickly remove the cooling fluid from the strip surface so that control of cooling efficiency become easier.

According to another aspect of the invention, a slit laminar flow nozzle for cooling an elongated strip transferred through a predetermined strip path, comprises a first and second plates arranged in side-by-side relationship to each other for defining therebetween a fluid path of a cooling fluid for establishing a slit laminar flow substantially perpendicular to a strip path, through which the strip is transferred, and means, responsive to fluid pressure within the fluid path, for causing displacement of the first plate relative to the second plate at a magnitude corresponding to the fluid pressure.

BRIEF DESSCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

Figure 8:
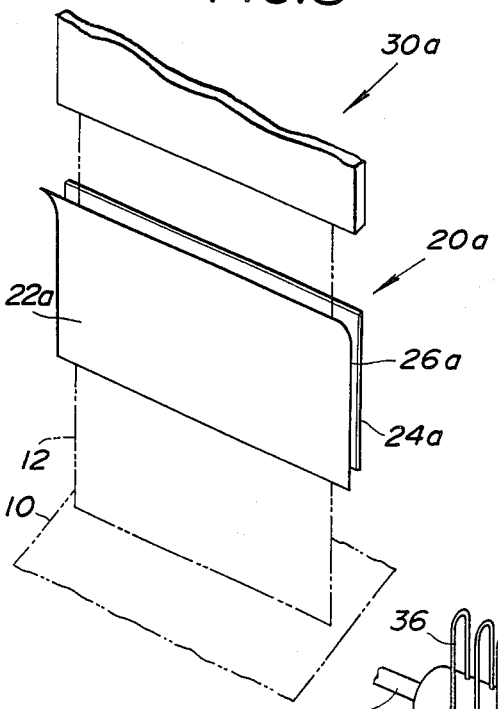
FIG. 8 is a fragmentary perspective view of a modification of the first embodiment of a strip cooling system according to the invention, which also constitute the fundamental embodiment of the invention.
Figure 9:
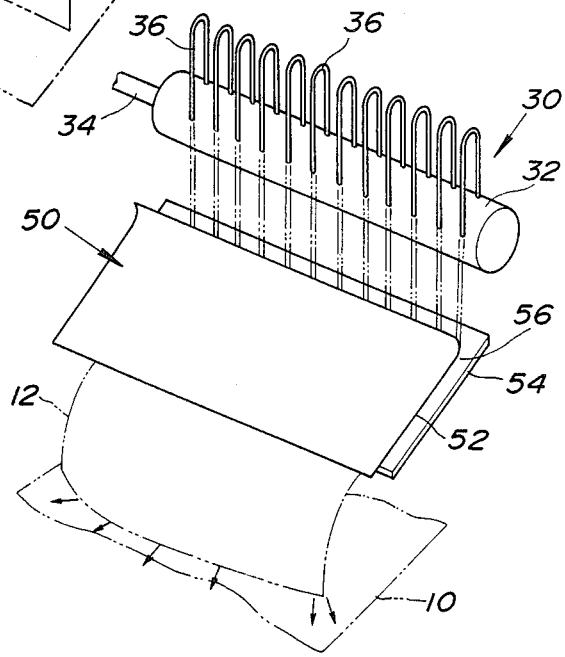
FIG. 9 is a fragmentary perspective view of the second embodiment of a strip cooling system according to the invention.
Figure 11:
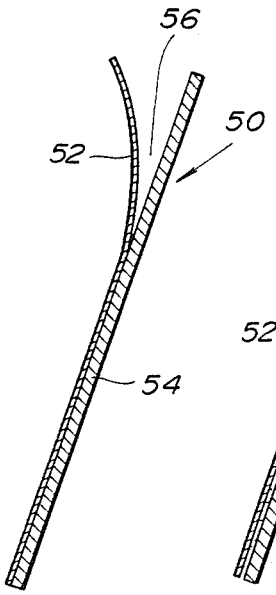
Figure 12:
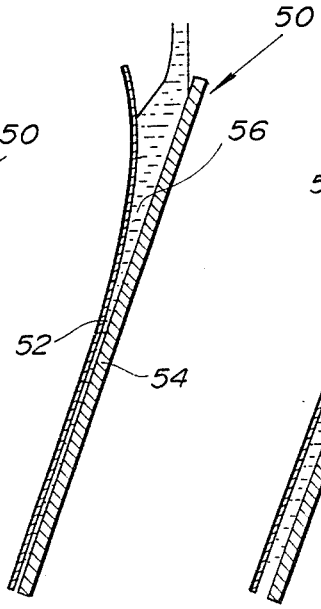
Figure 14:
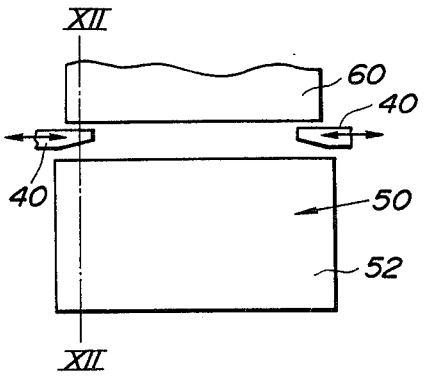
Figure 15:
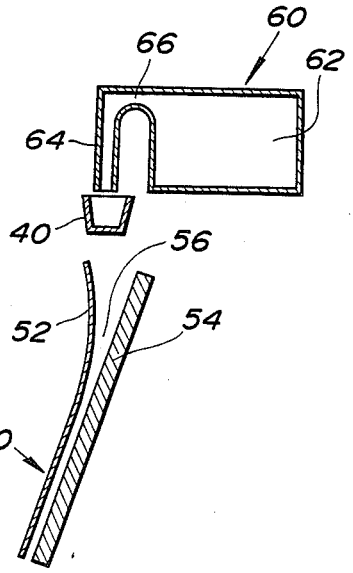
Figure 16:
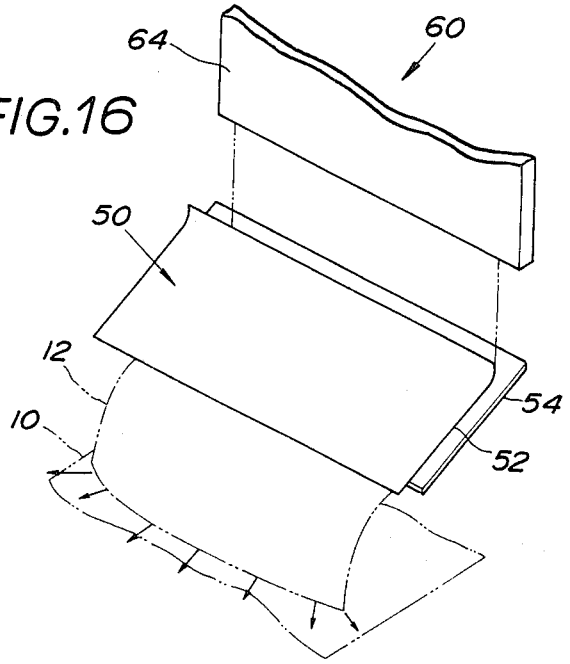
Figure 20:
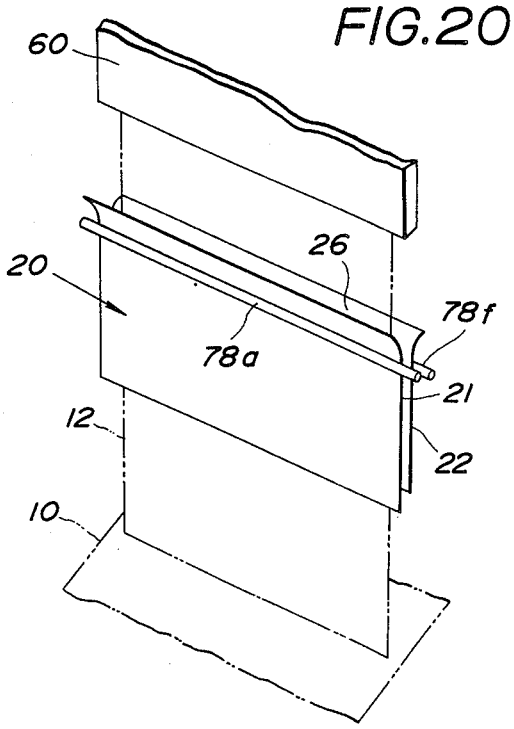
Figure 21:
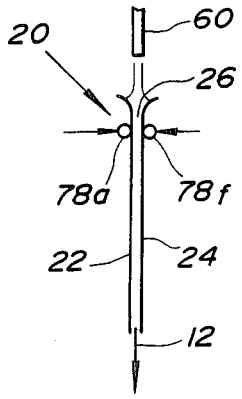
Figure 22:
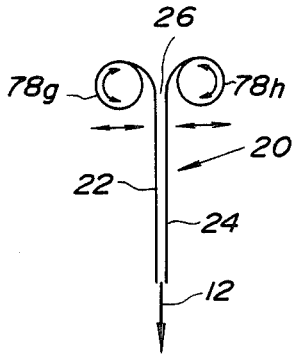
Figure 23:
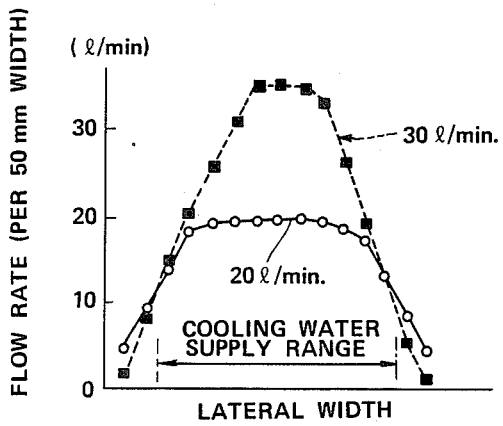
Figure 23:
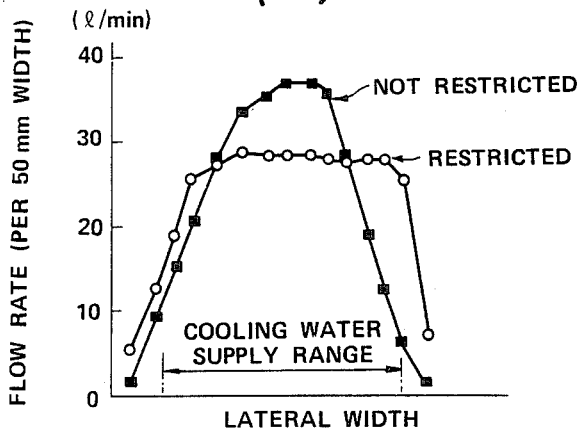
Figure 24:
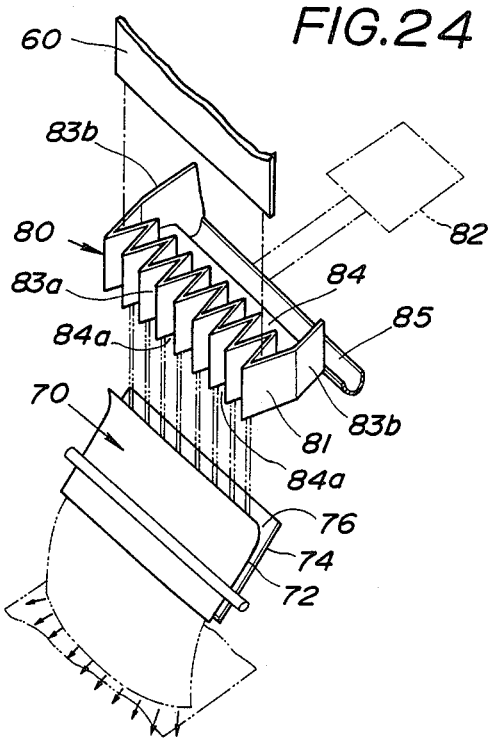
Figure 25:
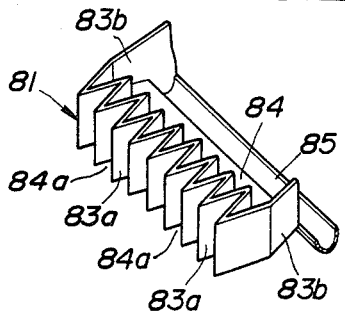
Figure 26:
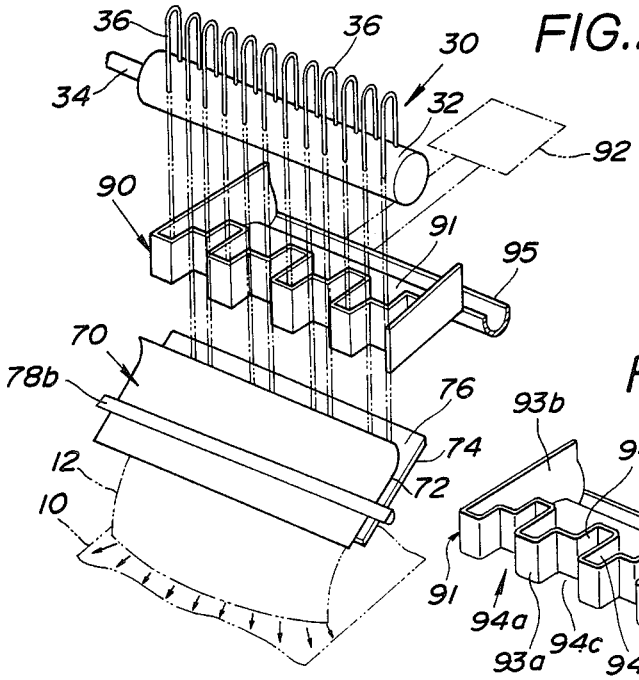
Figure 27:
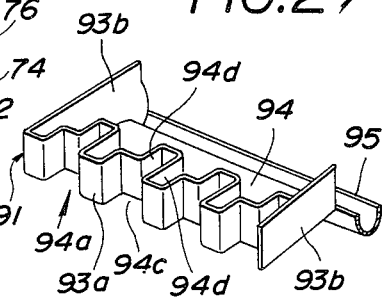
Figure 28:
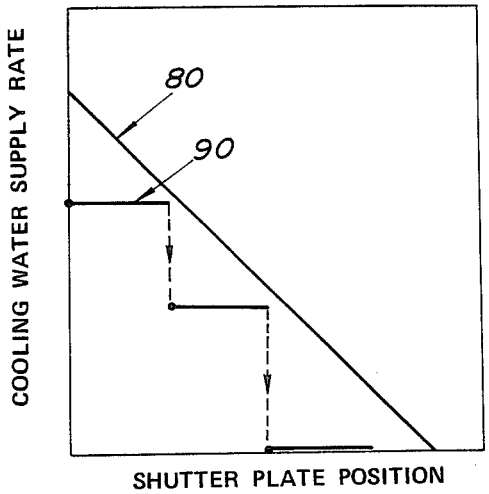
Figure 29:
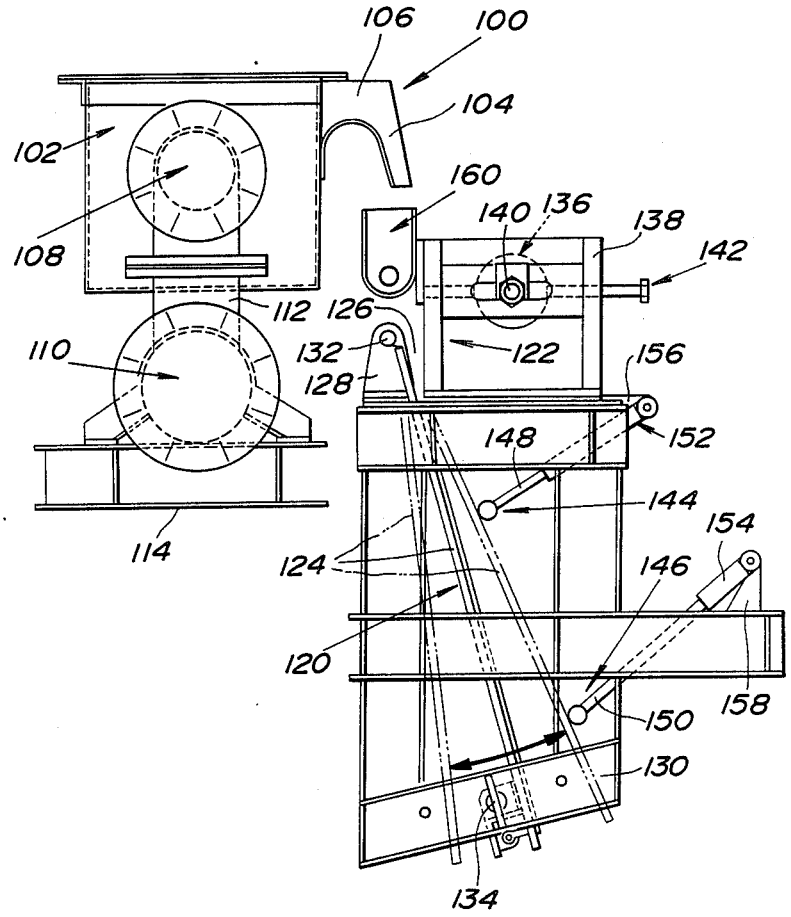
Figure 30:
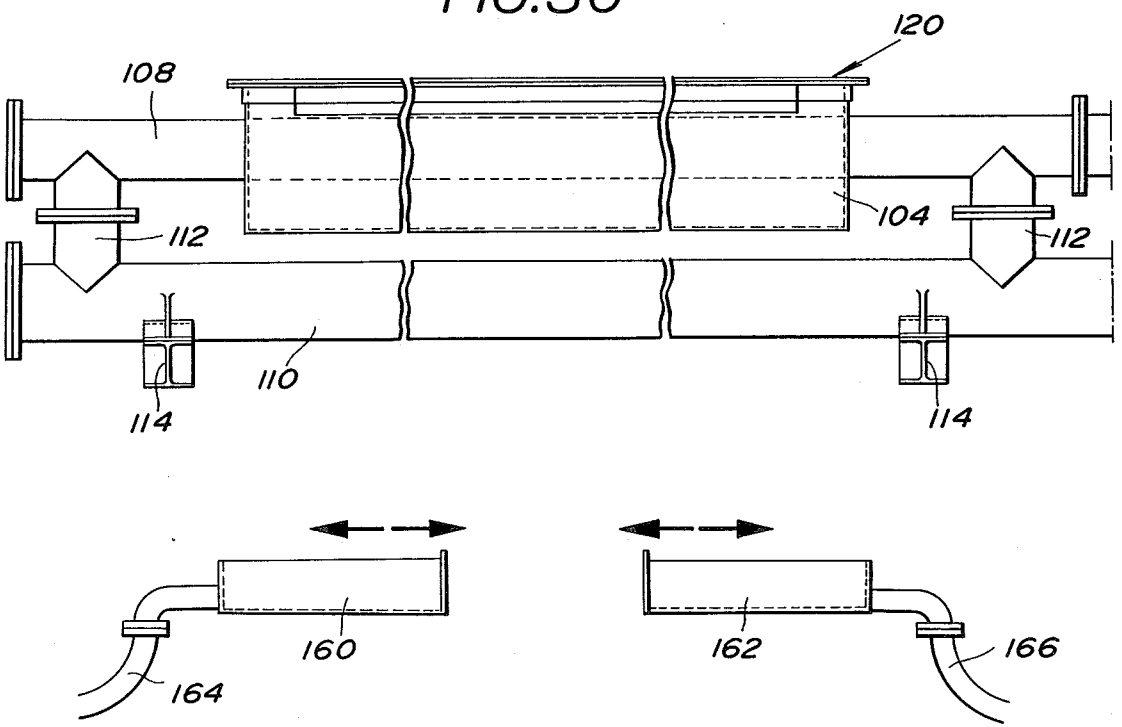
Figure 31:
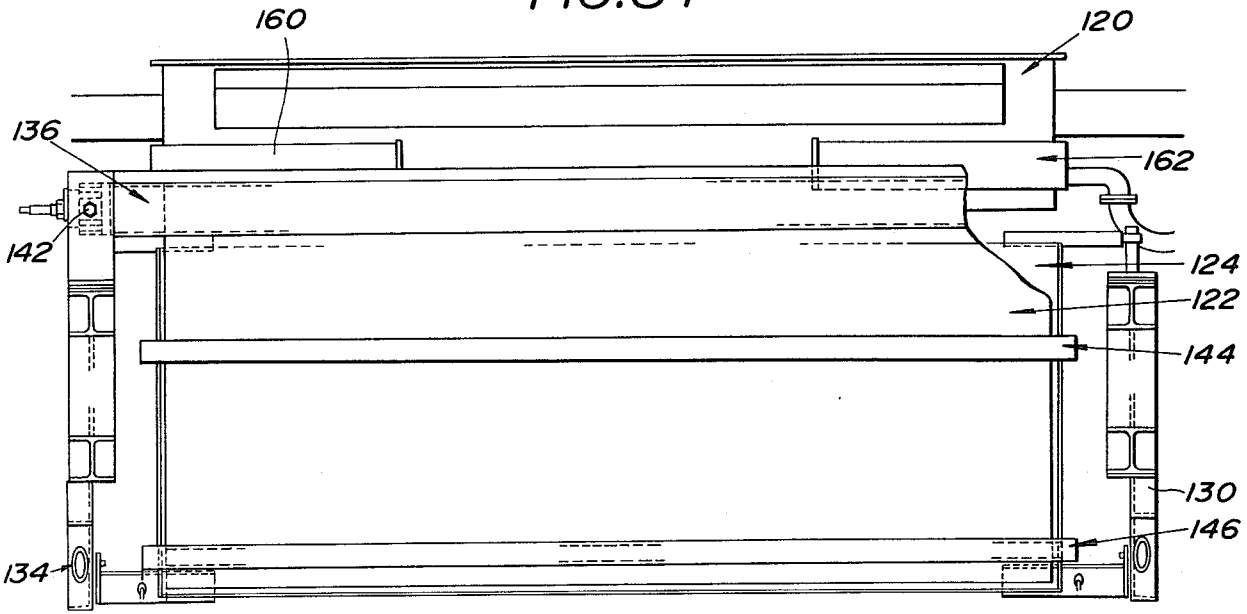

FIGS. 11, 12 ans 13 are enlarged section of the slit laminar flow nozzle to be employed in the second embodiment of the strip cooling system of FIG. 9;

FIG. 14 is a fragmentary front elevation of the second embodiment of the strip cooling system of FIG. 8;

FIG. 15 is an enlarged section of the second embodiment of the strip cooling system, taken along line XII—XII of FIG. 14;

FIG. 16 is a fragmentary perspective view of a modification of the second embodiment of the strip cooling system of FIG. 8;

FIG. 17 is a fragmentary perspective view of the third embodiment of a strip cooling system according to the invention;

FIG. 18 is a section of the third embodiment of the strip cooling system of FIG. 17;

FIG. 19 is a section of a modified embodiment of the third embodiment of the strip cooling system of FIG. 17;

FIG. 20 is a fragmentary perspective view of another modification of the third embodiment of the strip cooling system of FIG. 17;

FIG. 21 is a section of the modified embodiment of the strip cooling system of FIG. 20;

FIG. 22 is a section of a further modification of the strip cooling system derived from the embodiment of FIG. 20;

FIGS. 23 (A) and 23 (B) are charts respectively showing cooling water flow rate distribution in the direction of the width of the strip;

FIG. 24 is a fragmentary perspective view of the fourth embodiment of a strip cooling system according to the invention;

FIG. 25 is a perspective view of a flow control member employed in the fourth embodiment of the strip cooling system of FIG. 24;

FIG. 26 is a fragmentary perspective view of a modification of the fourth embodiment of the strip cooling system of FIG. 24;

FIG. 27 is a perspective view of a modified construction of a flow control member to be employed in the strip cooling system of FIG. 26;

FIG. 28 is a graph showing variation of the cooling water supply rates controlled by the flow control members of FIGS. 25 and 27;

FIG. 29 is a side elevation of the fifth and practical embodiment of a strip cooling system for implementing the present invention;

FIG. 30 is a front elevation of the lower section of the fifth embodiment of the strip cooling system of FIG. 29; and FIG. 31 is a front elevation of the upper section of the fifth embodiment of the strip cooling system of FIG. 29, in which the lower section overlapping with the upper section is neglected to explanatory illustrate the part hidden by the part of the lower section.

DESCRIPTION OF THE PREFERRED EMBODIMENT

Figure 1:
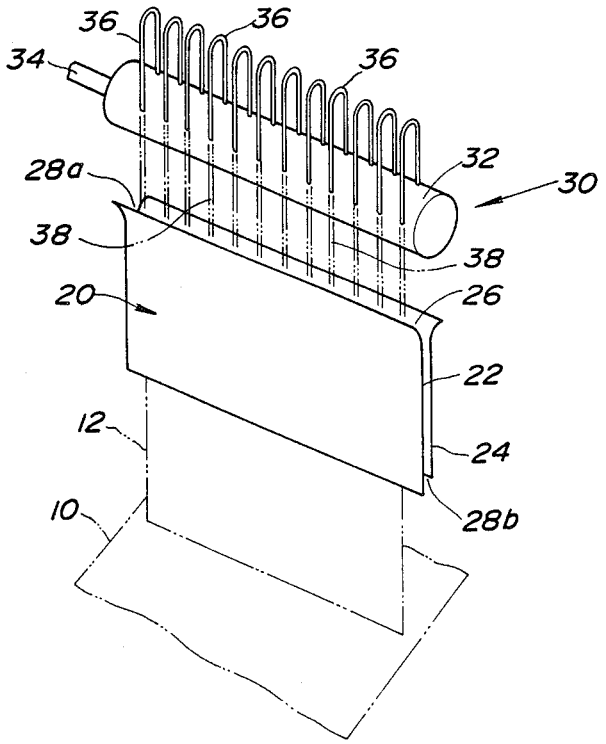
FIG. 1 is a fragmentary perspective view of the first and fundamental embodiment of a strip cooling system according to the present invention.
Figure 2:
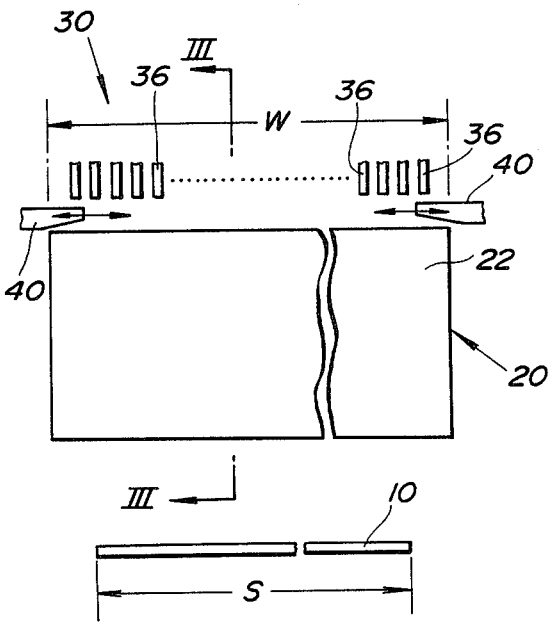
FIG. 2 is a fragmentary front elevation of the first embodimment of the strip cooling system of FIG. 1.
Figure 3:
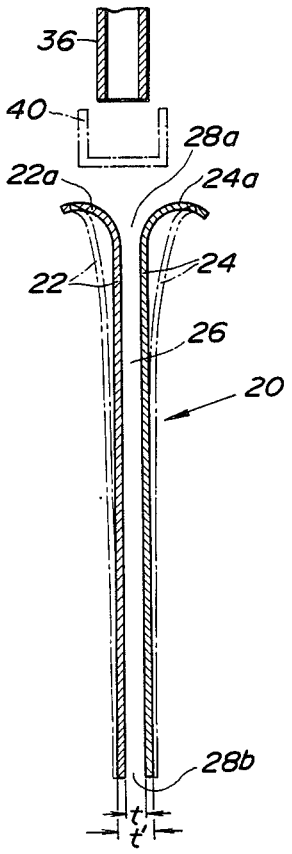
FIG. 3 is an enlarged section of the first embodiment of the strip cooling system, taken along line III—III of FIG. 2.

Referring now to the drawings, particularly to FIGS. 1 through 3, there is illustrated the first and fundamental embodiment of a strip cooling system according to the invention. In general, the shown embodiment of the strip cooling system according to the invention is adapted to establish a slit laminar flow of a cooling fluid for cooling a strip. The shown embodiment of the strip cooling system is particularly applicable in a hot strip mill lines manufacturing steel strip for cooling a steel strip 10 transferred from a finishing mill (not shown) to a take-up roll (not shown) along a run-out table. The slit laminar flow of the cooling fluid is established to extend substantially vertically and in perpendicular to the longitudinal axis of the steel strip. In practice, the shown embodiment of the steel strip cooling system employs cooling water as the cooling fluid. Therefore, the following disclosure will be given for the strip cooling systems for cooling strip by establishing slit laminar flow of cooling water. However, it should be appreciated, the cooling fluid can be replaced with any fluid state cooling medium as desired.

As shown in FIGS. 1 through 3, the first embodiment of the strip cooling system employs a slit laminar flow nozzle 20 for establishing a slit laminar flow 12 of cooling water. The cooling water is supplied through a cooling water supply means 30 which is connected to a cooling water source (not shown). The slit laminar flow nozzle 20 and the cooling water supply means 30 are arranged in essentially vertical alignment with each other. As shown in FIG. 1, the shown embodiment of the strip cooling system employs a pipe laminar flow nozzle as the cooling water supply means 30.

The pipe laminar flow nozzle as the cooling water supply means 30 is placed above the slit laminar flow nozzle 20. The slit laminar flow nozzle 20 comprises a pair of flow guide plates 22 and 24. The flow guide plates 22 and 24 are vertically arranged in side-by-side relationship to the other and extend substiantially perpendicular to the longitudinal axis of the strip 10. The flow guide plates 22 and 24 are spaced apart each other with a given clearance therebetween. The clearance between the flow guid plates 22 and 24 serves as a slit gap 26, through which the cooling water supplied from the cooling water supply means flows. The distance between the opposing surfaces of the flow guide plates 22 and 24 determines a thickness t of the slip gap 26.

The flow nozzle 30 comprises a greater diameter gallery pipe 32 and a plurality of discharge pipes 36 arranged in axial alignment with respect to the axis of the gallery pipe. The gallery pipe 32 extends in a direction of the width of the steel strip 10, which direction is perpendicular to the feed direction of the steel strip 10. The gallery pipe 32 is connected to a cooling water source (not shown) through a cooling water supply tube 34. Pressurized cooling water is fed through the cooling water supply tube 34 and introduced into the gallery pipe 32. The pressure of the cooling water flowing through the cooling water supply tube 34 may be controlled at a given pressure corresponding to a desired cooling water discharge rate through the discharge pipes 36. The discharge pipes 36 are connected to the gallery pipe 32 at one ends and downwardly directed to oppose the slit gap 26 of the slit laminar flow nozzle 20 at the other ends. Since the slit gap 26 of the slit laminar flow nozzle 20 extends substantially perpendicular to the feed direction of the steel strip 10, the discharge ends of the discharge pipes 36 of the pipe laminar flow nozzle 30 are aligned in a direction parallel to the slit gap 26 of the slit laminar flow nozzle.

In the preferred embodiment, the flow guide plates 22 and 24 are movably supported by means of an appropriate support means (not shown) so that they can be shifted relative to the other in response to the cooling water pressure within the slit gap 26. Furthermore, in the shown embodiment, the flow guide plates 22 and 24 are formed of thin and deformable stainless plates. However, in practice, the flow guide plates may be formed in any suitable and elastically or resiliently deformable material, such as tin plate, aluminium plate, Teflon (fluon), polyethylene, polypropylene and so forth. It should be also appreciated that the distance between the pipe laminar nozzle 30 and the slit laminar nozzle 20 may be determined at any desired distance. However, it would be preferable to select the distance to place the pipe laminar flow nozzle 30 close enough to the upper end of the slit laminar flow nozzle 20 in order to reduce the height of the apparatus. In addition, it would also be possible to insert the lower end of respective discharge pipes 36 into the slit gap 26 of the slit laminar flow nozzle 14.

It should be further appreciated that the pipe laminar flow nozzle 30 is provided only for the purpose of cooling water supply for the slit laminar nozzle 20. Therefore, the pipe laminar nozzle 30 is not required to have uniformity of the discharge rate through each discharge pipe 36. In this view, the discharge pipes to be employed in the pipe laminar flow nozzle 30 are not necessary to be accurate circular configuration but can be any desired configuration, such as oval shape, polygon shape and so forth. In addition, since the pipe laminar flow nozzle 30 as the cooling water supply means is only required to supply sufficient amount of cooling water to form the slit laminar flow 12 of the cooling water as discharge through the slit laminar flow nozzle 20, it should not be limited to the pipe laminar flow nozzle but can be replaced with any type of water supply means. However, pipe laminar flow nozzles or slit lamminar flow nozzles may be preferred in order to provide uniformity in water supply at various part of the slit gap of the slit laminar flow nozzle 20.

As shown in FIGS. 2 and 3, the first embodiment of the strip cooling system according to the invention, further employs a shutter members 40 generally located at positions corresponding to both lateral ends of the slit laminar nozzle 20. The shutter members 40 are laterally movable along the slit gap 26 for interferring part of cooling water supply through the pipe laminar flow nozzle 30. As will be apparently seen from FIG. 3, each shutter member 40 is of channel-shaped configuration to define therein a gutter for draining the cooling water received therein. The shutter members 40 are cooperatively associated with actuators (not shown) to be horizontally driven to adjust flow restriction magnitude. Namely, when the shutter members 40 are driven toward each other, the bar-form laminar flows discharged from the discharge pipes 36 and received by the shutter member to be drained is increased to increase flow restriction magnitude. In practice, the positions of the shutter members 40 are determined according to the width S of the strip to be cooled.

It should be convenient to bend the upper end of the flow guide plates 22 and 24 to widen the upper opening mouth **28*a* of the slit gap 26 in comparison with the outlet 28*b* thereof to assure reception of the cooling water discharged from the discharge pipes 36 of the pipe laminar flow nozzle 30**.

The cooling efficiency adjusting operation in the above mentioned first embodiment of the strip cooling system according to the invention will be discussed herebelow.

The cooling water supplied through the pipe laminar flow nozzle 30 is supplied into the slit gap 26 between the flow guide plates 22 and 24, in a form of bar-form laminar flow. At this time, the cooling water supply area in the slit gap 26 is adjusted according to the width S of the strip 10 to be cooled by adjusting the positions of the shutter members 40. The cooling water entering into the slit gap 26 expands along the flow guide plates 22 and 24 because of the surface tension of the cooling water. Therefore, the screen-form laminar cooling water flow 12 is formed through the slit laminar flow nozzle 20.

In order to control the cooling water flow amount for adjusting cooling efficiency, the discharge rate of the cooling water through the pipe laminar flow nozzle 30 may be adjusted. Adjustment of the discharge rate through the pipe laminar flow nozzle 30 may be performed by adjusting cooling water supply rate to the gallery pipe 32 from the cooling water source through the cooling water supply tube 34, or otherwise by adjusting cooling water pressure in the gallery pipe 32. By adjusting the discharge rate of the cooling water to be discharged from the pipe laminar nozzle 30, cooling water flow rate through the slit gap 26 is varied. This causes variation of the cooling water pressure in the slit gap 26 due to flow restriction by the path area defined in the gap. When cooling water pressure increases, the flow guide plates 22 and 24 of the slit laminar flow nozzle 26 is shifted away from each other at a magnitude corresponding to the magnitude of the cooling water pressure in the slit laminar flow nozzle, as shown by phantom line in FIG. 3. Simultaneously, the flow guide plates 22 and 24 are elastically or resiliently deformed due to the pressure. Such displacement and deformation of the flow guide plates 22 and 24 widen the thickness t of the slit gap 26 and whereby widen the path area for the cooling water. Magnitude of relative displacement and deformation of the flow guide plates 22 and 24 are thus automatically determined depending upon the cooling water pressure created by the flow restriction. Namely, displacement and deformation of the flow guide plates 22 and 24 are caused in a magnitude to balance the resiliency of the flow guide plates 22 and 24 and the cooling water pressure in the slit gap 26. Therefore, by automatically displacing and deforming the flow guide plates 22 and 24, the cooling water pressure to be discharged through the slit laminar flow nozzle 20 can be maintained at substantially constant pressure. Consequently, by selecting the resiliency of the flow guide plates 22 and 24 and characteristics of displacement thereof, cooling water pressure can be adjusted so as to prevent the cooling water from being discharged with excessive pressure to cause sprushing of the water on the steel strip 10. Furthermore, since the shown embodiment of the strip cooling system allows expansion of the slit gap 26 in the slit laminar flow, the initial thickness t of the slit gap can be small enough to lower allowable minimum cooling water flow rate which is required for maintaining slit laminar flow without causing breaking of the laminar flow.

Figure 4:
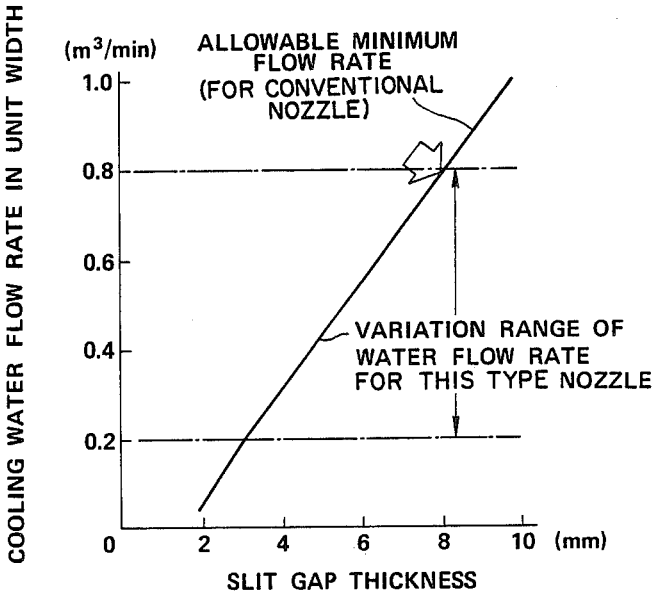
FIG. 4 is a graph showing allowable minumum cooling water flow rate in relation to the thickness of a slit gap defined in a slit laminar flow nozzle employed in the first embodiment of the strip cooling system of FIG. 1.

As will be appreciated that, since the slit laminar flow nozzle 20 can vary the slit gap 26 depending upon the cooling water pressure in the gap to widen the cooling water flow path area when the cooling water pressure increases, the flow guide plates 22 and 24 can be arranged in crossly arranged position for defining substantially small path area. At this initial position, the flow guide plates 22 and 24 defines the minimum cooling water flow path area in the slit gap 26. As set forth above, since the minimum gap can be small enough to lower the allowable minimum cooling water flow rate to lower, the lowermost strip cooling efficiency become smaller than that in the conventional slit laminar flow nozzles. This advantages of the shown embodiment will be seen clearly in FIG. 4. In FIG. 4, the allowable minimum cooling water flow rate in a unit width is illustrated by the solid line. On the other hand, the range of unit cooling water flow rate which is cooling water flow rate in the unit width, according to the shown embodiment is illustrated by the phantom line in FIG. 4, as the thickness of the slit gap varies between the initial thickness t (e.g. 3 mm) and the maximum thickness t' (e.g. 8 mm). In further detail, when the conventional slit laminar flow nozzle has a fixed slit gap of 6 mm, the required mimumum cooling water flow rate is 0.55 $m^3$/min. On the other hand, by setting the minimum thickness of the slit gap 26 at 3 mm, the required minimum cooling water flow rate can be reduced to 0.2 $m^3$/min. Therefore, this first embodiment of the strip cooling system may provide wide range adjustment of the cooling water discharge rate and whereby provide wide range adjusting ability of cooling efficiency of the strip on the run-out table in the rolling process.

Figure 5:
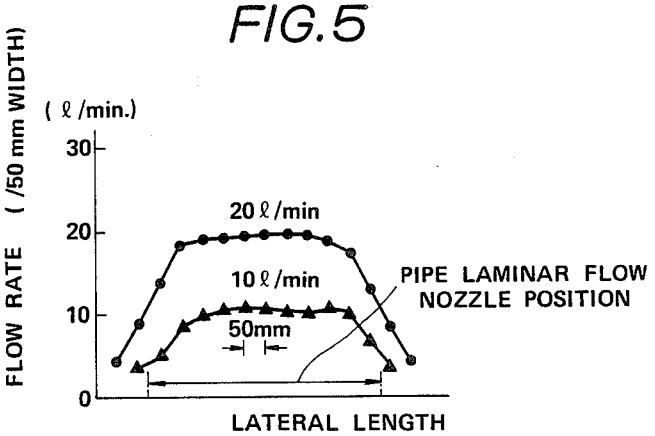
FIG. 5, is a chart showing cooling water flow rate distribution in a direction of the width of a strip to be cooled.
Figure 6:
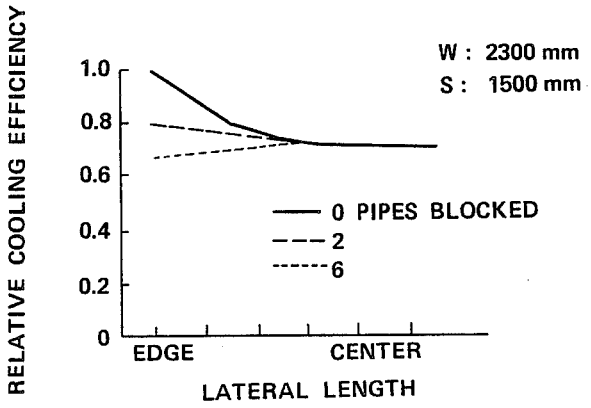
FIGS. 6 and 7 show relative cooling efficiency at various cooling water flow restriction magnitude.
Figure 7:
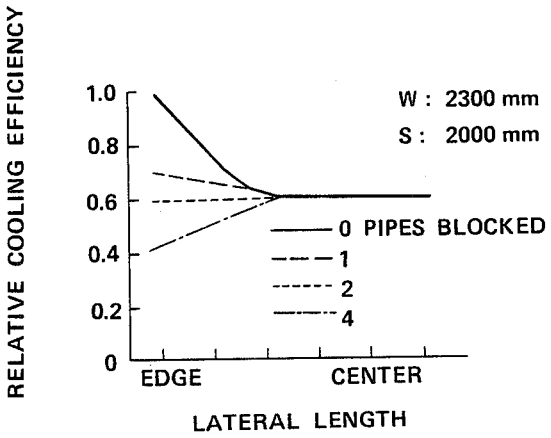

On the other hand, as will be seen from FIG. 5, the cooling water flow rate distribuation at various portion of the slit laminar nozzle 20 can be substantially uniform at the central portion. The flow rate at side portions are reduced substantially in linear fashion. This flow rate reduction characteristics at both lateral sides of the slit laminar flow nozzle 20 can be adjusted by adjusting the position of the shutter members 40. Relation between the flow rate distribution variation characteristics and the position of the shutter members 40 will be seen from FIGS. 6 and 7. The characteristics shown in FIGS. 6 and 7 are derived from experimentations performed in a condition that the diameter of each discharge pipe 36 is 20 mm, the interval between the discharge pipes is 50 mm, the overall width W of the slit laminar flow nozzle is 2300 mm, the cooling water flow rate through each discharge pipe 36 is 0.015 $m^3$/min. and the unit cooling water flow rate through the slit laminar flow nozzle 20 is 0.69 $m^3$/min. Under this condition, the first experimentation is performed for cooling the steel strip of the width of 1500 mm with blocking bar-form laminar flow of the cooling water through 0, 2 and 6 discharge pipes 36. The result is illustrated in a relative cooling efficiency at various lateral portions of the strip. From the result, it is appreciated that for obtaining substantially uniform cooling efficiency through overall width of the strip, 2 bar-form laminar flow through 2 discharge pipes 36 are to be blocked. The second experimetation is performed for cooling the steel strip of the width of 2000 mm by blocking 0, 1, 2 and 4 bar-form laminar flow through 0, 1, 2 and 4 discharge pipes 36. From the result, it is appreciated that when 2 bar-form laminar flow are blocked, substantially uniform cooling efficiency can be obtained through overall width of the strip 10. From this, it should be appreciated that it is advantages to limit cooling water supply rate by blocking part of laminar flow to be supplied to the slit laminar flow nozzle 20 for obtaining uniform cooling efficiency through overall width.

As set forth above, various modifications of the first embodiment of the strip cooling system may be possible to implement the present invention. One of the modification is illustrated in FIG. 8. In the modified embodiment of FIG. 8, slit laminar flow nozzle **30*a* is employed as the cooling water supply means. The slit laminar flow nozzle 30*a* is arranged above a slit laminar flow nozzle 20*a* which comprises a flow guide plates 22*a* and 24*a*. Similarly to the foregoing embodiment, the flow guide plate 22*a* is formed of a thin and elastically or resiliently deformable material, such as thin stainless plate. On the other hand, in the shown embodiment, the flow guide plate 24*a*** is formed of a rigid material, such as relatively thick stainless plate. The flow guide plate 24*a* is rigidly fixed along the cooling water path for forming the stationary wall for defining the slit gap 26*a*. The flow guide plate 22*a* is movably supported by appropriate support so that it may move toward and away from the flow guide plate 24*a* in order to adjust the thickness of the slit gap according to the cooling water pressure within the slit gap 26*a*.

With this construction, the slit gap thickness is variable depending on the cooling water pressure within the slit gap by displacement of the flow guide plate 22*a* relative to the flow guide plate 24*a* by resilient deformation of the flow guide plate 22*a*. Therefore, wide range cooling water flow rate adjustment becomes possible as similar to that in the foregoing first embodiment.

Though the embodiment of FIG. 8 is not facilitated with the shutter member as illustrated in FIGS. 2 and 3 of the first embodiment, similar flow restriction will be possible by providing the shutter members. In such case, the uniformity of the cooling efficiency distribution will become variable depending upon flow restriction magnitude.

FIGS. 9 through 13 show the second embodiment of the strip cooling system according to the invention. In this embodiment, the pipe laminar flow nozzle 30 of the identical construction to that in the foregoing first embodiment has been employed as the cooling water supply means. On the other hand, the slit laminar flow nozzle 50 has similar construction as the laminar flow nozzle 20*a* in illustrated in FIG. 8. Therefore, the slit laminar flow nozzle 50 comprises a deformable and removable flow guide plate 52 and a rigid flow guide plate 54. However, the slit laminar flow nozzle 50 in this embodiment is inclined to lie on a plane extending oblique to the substantially vertical plane. In the preferred construction, the inclination angle of the slit laminar flow nozzle 50 with respect to the vertical plane is about 15°.

Figure 13:
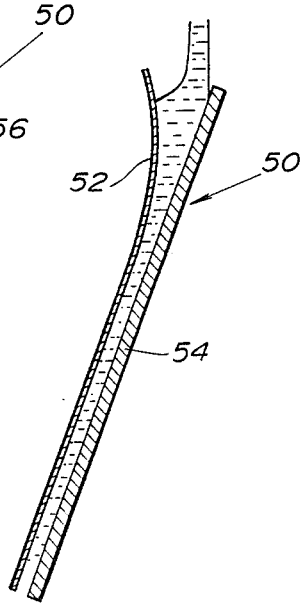

As shown in FIGS. 11, 12 and 13, the flow guide plate 52 displaces relative to the flow guide plate 54 depending upon the cooling water flow rate in the slit laminar nozzle 50. Namely, FIG. 11 show the initial position of the flow guide plate 52. In this condition, no cooling water is supplied or substantially small flow rate of the cooling water is supplied to the laminar flow nozzle 50 to maintain the slit gap 56 at minimum and initial thickness. FIG. 12 shows a condition in which relatively small flow rate which is clearly greater than that in the initial position, of cooling water is supplied to the slit laminar flow nozzle 50. By supplying the increased amount of the cooling water, the pressure in the slit gap 56 increases to cause the flow guide plate 52 to be displaced relative to the flow guide plate 54 to allow greater amount of cooling water to flow therethrough. When the cooling water supply amount is further increased, the flow guide plate 52 is further displaced away from the flow guide plate 54 to increase the thickness of the slit gap 56, as shown in FIG. 13. Therefore, the cooling water flow rate can be automatically adjusted by varying the thickness of the slit gap without causing significant change of the discharge pressure of the cooling water through the slit laminar flow nozzle 50.

Figure 10:
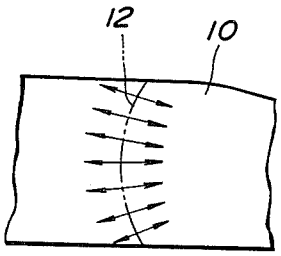
FIG. 10 is an illustration showing cooling water flow on the strip.

By providing inclination angle for the slit flow laminar nozzle 50, the flow energy of the cooling water flowing through the slit laminar flow nozzle, will have vertical component and horizontal component. As will be natually understood, the horizontal component becomes maximum at the center of the slit laminar flow and minimum at the lateral side edges. Therefore, the slit laminar flow 12 established by the slit laminar flow nozzle 50 becomes sectionally arc-shape, as shown in FIGS. 9 and 10. This provides flow directionarity for the cooling water to flow on the steel strip 10 in essentially radial direction to remove the cooling water on the strip in a shorter period. Since the strip cooling efficiency will depend not only on the cooling water flow rate to be discharged onto the steel strip but also the period of time while the cooling water is maintained on the strip, the period of time to maintain the cooling water will be generally undeterminated factor in precisely controlling the strip cooling efficiency. This can be solved by shortening the period to maintain the cooling water by providing radial flow characteristics for the cooling water on the strip. This make it easier to determine the cooling efficiency with the unit cooling water flow rate to allow more precise cooling efficiency control.

FIGS. 14 through 16 show a modification of the foregoing second embodiment of the strip cooling system. In this embodiment, a slit laminar flow nozzle 60 is employed as a replacement of the pipe laminar flow nozzle for supplying the cooling water to the slit laminar flow nozzle 50. Furthermore, the shown modification also employs the shutter member 40 which has been described with respect to the first embodiment of the strip cooling system of FIGS. 1 to 3.

As will be seen from FIG. 15, the slit laminar flow nozzle 60 comprises a reservoir section 62 and a nozzle section 64. The reservoir section 62 is connected to the cooling water source (not shown) in per se well known manner. The cooling water accumulated in the reservoir section 62 is fed to the nozzle section 64 through a communication passage 66 formed between the reservoir section and the nozzle section. On the other hand, the shutter members 40 will be horizontally shifted to block part of cooling water supply for adjusting cooling efficiency in various part of the strip to be substantially uniform.

FIGS. 17 and 18 show the third embodiment of a strip cooling system according to the invention. In the shown embodiment, the slit laminar flow nozzle 60 which is identical to the foregoing embodiment of FIGS. 14 to 16. The slit laminar flow nozzle 60 is arranged above a slit laminar flow nozzle 70 which is adapted to establish laminar flow 12 of the cooling water. Similarly to the foregoing second embodiments, the slit laminar flow nozzle 70 generally comprises a resiliently deformable and movable flow guide plate 72 and a rigid flow guide plate 74. The flow guide plate 74 is rigidly fixed to plane a flow guide plate substantially parallel to the laminar flow of the cooling water from the slit laminar nozzle 60. On the other hand, the flow guide plate 72 is placed adjacent the flow guide plate 74 in side-by-side relationship for defining a slit gap 76 therebetween. In addition, the slit laminar flow nozzle 70 comprises upper and lower depression members 78*a* and 78*b*. Preferably, the depression members 78*a* and 78*b* respective comprise a cylindrical bars. In the preferred construction, the depression members 78*a* and 78 of the cylindrical bars respectively extends adjacent upper and lower edges of the flow guide plate 72 The depression members 78*a* and 78*b* are cooperated with actuators 78*c* and 78*d* (not shown). In the shown embodiment, the actuastors 78*c* and 78*d* comprises actuation cylinders, such as as air cylinder, hydraulic cylinder and so forth for moving the depression members 78*a* and 78*b* toward and away from the flow guide plate 72. However, the actoators may comprise spring means and so forth. The actuators actuates the depression members 78*a* and 78*b* for exerting depression forces $F_1$ and $F_2$ onto the flow guide plate 72. The depression force to be exerted through the depression members 78*a* and 78*b* serve as limiting force for limiting displacement of the flow guide plate 72 relative to the flow guide plate 74 and for limiting deformation magnitude of the flow guide plate 72.

In the practical operation, the actuators 78*c* and 78*d* are operated to exert a given magnitude of depression pressure through the depression members 78*a* and 78*b* to the flow guide plate 72. Therefore, as long as the cooling water pressure within the slit gap 76 is smaller than that of the depression pressure of the depression members 78*a* and 78*b*, displacement of the flow guide plate 72 never occurs. Therefore, the discharge pressure of the cooling water discharged from the slit laminar nozzle 70 can be determined by the depression force of the actuators 78*c* and 78*d*. Restriction of displacement and deformation of the flow guide plate 72 will provide higher unitofrmity of cooling water flow rate distribution over the width of the strip.

FIG. 19 is a modified construction of the third embodiment of the strip cooling system of FIGS. 17 and 18. In this modification, the slit laminar flow nozzle 70 is arranged in oblique to the vertical plane as that discusses with respect to the second embodiment of the invention. The thin stainless plate is employed as the flow guide plate 72. The flow guide plate 72 is fixed to a roller or rotary bar 78*e* at the top edge 72*a* thereof. Since the flow guide plate 72 is fixed to the rotary bar 78*e* only at the top thereof, resilient force thereof to return to flat will be exerted to the overall structure of the flow guide plate 72 to resiliently contact the major portion thereof to the flow guide plate 74. The resilient force to be created by the flow guide plate 72 per se can be adjusted by adjusting the position of the top edge thereof by rotating the rotary bar 78*e*. On the other hand, adjacent the lower edge of the flow guide plate 72, the depression member 78*b* is provided. Similarly to the foregoing embodiment, the depression member 78*b* is cooperated with the actuator 78*d* to be operated toward and away from the flow guide plate 72 to exert a controlled magnitude of depression force.

With this construction, the restriction for deformation and displacement of the flow guide plate 72 can be accomplished.

FIGS. 20 and 21 show another modification of the third embodiment of the strip cooling system of FIGS. 17 and 18. In this modification, the slit laminar flow nozzle 20 comprises a pair of resiliently deformable and movable flow guide plates 22 and 24 as similar to that of the foregoing first embodiment of FIGS. 1 through 3. The depression members 78*a* and 78*f* are provided adjacent the top edge of respective flow guide plates for restricting relative displacement of the flow guide plates. Similar restriction of the displacement can be achieved by the construction of FIG. 22. In the modification of FIG. 22, the top edges of the resiliently deformable flow guide plates 22 and 24 are fixed to rotary rollers or bars 78*g* and 78*h*. By fixing the top edges onto the rotary bars 78*g* and 78*h*, the resilient force is created by the flow guide plates per se for resiliently biasing the flow guide plates toward the other.

Therefore, in both modifications, deformation and displacement magnitude of the deformable flow guide plates 22 and 24 can be restricted.

FIGS. 23(A) and 23(B) show cooling water flow rate distribution over the overall width of the slit laminar flow nozzles 70 and 20. FIG. 23(A) shows flow rate distribution when the deformation and displacement of the deformable flow guide plates is not limited. As will be seen herefrom, by increasing unit flow rate of the cooling water through the slit laminar nozzle 60, region of the slit laminar flow 12 to be provided the uniform rate of the cooling water flow is narrowed. On the other hand, by providing restriction for the deformable flow guide plate for limiting magnitude of deformation and displacement, relatively wide uniform flow rate region can be obtained, as clearly seen from FIG. 23(B).

FIG. 24 shows the fourth embodiment of a strip cooling system according to the invention. The shown embodiment employs the slit laminar flow nozzles 60 and 70 of the identical construction as that illustrated in FIGS. 17, 18 and 19. A flow control member 80 is disposed between the vertically arranged slit laminar flow nozzles 60 and 70.

As shown in FIG. 25, the flow control member 80 comprises a shutter plate 81 and an actuator 82 which is adapted to drive the shutter plate 81 toward and away from the cooling water path defined between the upper and lower slit laminar flow nozzles 60 and 70. As shown in FIG. 10, the shutter plate 81 comprises a substantially horizontally extending major flat section 84 with a plurality of generally triangular cut-outs 84*a* formed at the front end thereof. The shutter plate 81 is also provided with a gutter section 85 integrally formed at the rear end of the major flat section 84. A vertical front wall 83*a* which is integrally formed with side walls 83*b*. Therefore, the major section 84 with the front all 83*a* and side wall 83*b* defines a cooling water shutting space for receiving the part of or full amount of cooling water discharged from the upper laminar flow nozzle 60 for draining through the gutter section 85.

Since the triangular cut-outs 84*a* with the front wall 83*a* defines cooling water flowing recess gradually widening the path area toward the front end, the cooling water path area is gradually reduced as the shutter plate 81 is driven frontwardly toward the cooling water path between the upper and lower slit laminar nozzles 60 and 70 by means of the actuator 82. Therefore, cooling water supply rate may be adjusted by controlling the position of the shutter plate 81.

As set forth above, since the deformation magnitude of the deformable flow guide plates 72 and 74 are variable for varying the thickness of the slit gap 76 of the slit laminar flow nozzle 70 is variable depending upon the cooling water pressure within the slit gap, the discharge rate of the cooling water through the slit laminar flow nozzle can be adjusted by controlling the shutter plate position. By this, the cooling efficiency for the steel strip can be adjusted.

FIG. 26 shows a modification of the fourth embodiment of the strip cooling system of FIG. 24 and 25. In this modification, the pipe laminar flow nozzle 30 is employed as the cooling water supply means for supplying the cooling water to the slit laminar flow nozzle 70. A modified construction of a flow control member 90 is disposed between the pipe laminar flow nozzle 30 and the slit lamminar flow nozzle 70. The flow control member 90 generally comprises a shutter plate 91 and an actuator 92 which drives the shutter plate horizontally toward and away from a cooling water path between the pipe laminar flow nozzle 30 and the slit laminar flow nozzle 70.

As shown in FIG. 27, the shutter plate 91 comprises a substantially plate and horizontally extending major section 94, a gutter section 95 formed along one edge of the major section remote from the aforementioned cooling water path and extending in parallel to the flow guide plates 15 and 16. The other end of the major section is formed with stepped cut-outs 94*a*, each comprising thinner cut-out 94*b* and deeper cut-out 94*c*. Vertical front end wall 93*a* extends along the edge of the major section 94 with the cut-outs 94*a*. The vertical front all 93*a* is integrally formed with side walls 93*b* extending along the side edges of the major section 94. Therefore, the vertical front wall 93*a* and side walls 93*b* enclose the horizontal plane of the major section 94 to guide the cooling water received on the horizontal plane to the gutter section 95. The gutter section 95 guides the cooling water to drain passage for draining. The front edge of the shutter plate 91 is moved toward and away from the cooling water path to adjust the cooling water supply rate to the slit laminar flow nozzle 70 and movable between at first remote position where the shutter plate 91 is placed away from the cooling water path to allow full amount of cooling water discharged through the pipe laminar flow nozzle 30 to be supplied in the slit laminar flow nozzle 70 and a second shutting position where the shutter plate fully closes the cooling water path to shut cooling water supply to the slit laminar nozzle 70. The shutter plate 91 may stop at any position during travel between the remote position and shutting position. For instance, the shutter plate 91 may stop at a position where the front end of the major section 94 is placed within the cooling water path of part of cooling water discharged from the pipe laminar flow nozzle 30 to pass therethrough to be supplied to the slit laminar flow nozzle 70 through the thinner and deeper cut-outs 94*b* and 94*c*. Therefore, limited amount of cooling water is supplied from the pipe laminar flow nozzle 30 to the slit laminar flow nozzle 70. The proportion of reduction of supply amount of the cooling water may be determined by the ratio of the open area, i.e. the width of the thinner and deeper cut-out with respect to the left sections 94*d*. When the shutter plate 91 further shifted toward the cooling water path, the thinner cut-outs 94*b* passes through the cooling water path. In this case, the cooling water supplied from the pipe laminar flow nozzle 30 is supplied to the slit laminar flow nozzle 70 only through the deeper cut-out section 94*c*. Therefore, proportion of water supply to the slit laminar flow nozzle 70 become further limited. As will be appreciated herefrom, according to the invention, the cooling water supply amount from the pipe laminar flow nozzle may be controlled at full shut (zero), first limited rate and second limited rate smaller than the first limited rate and full amount.

As will be seen from FIG. 26, when the cooling water supply is limited at the aforementioned first and second limited amount, the excessive cooling water received by the major section 94 of the shutter plate 94 is drained or returned to the cooling water source.

In this embodiment, since the slit laminar flow nozzle 70 comprises the deformable flow guide plates 72 and 74, adjustment of the path area in the slit gap 76 for adjusting the discharge rate and the discharge pressure of the cooling water through the slit laminar flow nozzle 70 as that established by the foregoing first embodiment, can be accomplished.

In addition, according to the shown fifth embodiment, since the shutter plate 91 will provide additional adjustment of the cooling water supply amount to the cooling water to the slit laminar flow nozzle. Since the shutter plate 91 may be driven by the actuator 92 mechanically or electrically, adjustment of the cooling water supply amount to the slit laminator flow nozzle 70 can be taken place quickly to improve responseability of the cooling water supply adjustment. Thus, it allows more precise cooling control for the rolled steel strip 10.

In the preferred embodiment, the width of the thinner cut-outs 94*b*, the deeper cut-out 94*c* and the left sections 94*d* are of equal width to each other. In this case, the cooling water supply amount is adjusted between 0, $\frac{1}{3}$, $\frac{2}{3}$ and full.

As set forth above, the flow control members 80 and 90 in the embodiments of FIGS. 24 to 27, the cooling water supply rate can be adjusted by adjusting the position of the shutter plates 81 and 91 in a manner illustrated in FIG. 28. Namely, when the shutter plate 81 is employed in the strip cooling system as illustrated in FIG. 24, the flow restriction achieved to vary the cooling water supply amount to the slit laminar flow nozzle 70 in linear fashion as illustrated by line A. On the other hand, when the shutter plate 91 is employed, the cooling water supply amount is varied in stepwise fashion as illustrated by line B. In either case, since the shutter plates 81 and 91 are mechanically driven by means of the associated actuators 82 and 92, relatively quick response in adjusting cooling water supply amount to the slit laminar flow nozzle 70 can be achieved. Therefore, control for cooling efficiency can be performed with improved responsability.

FIGS. 29 through 31 show the fifth and practical embodiment of a strip cooling system according to the invention. The shown embodiment of the strip cooling system generally comprises an upper laminaor flow nozzle 100 and a lower laminaor flow nozzle 120. The upper slit laminar flow nozzle 100 comprises a reservoir section 102 and a nozzle section 104 connected to the reservoir section through a communication passage 106. The reservoir section 102 is fixed to au upper cooling water supply pipe 108 which is connected to a lower cooling water supply pipe 110 through vertical pipes 112. The upper and lower cooling water supply pipes 108 and 110 are connected to a cooling supply source (not shown) through cooling water supply lines to supply the cooling water to the reservoir section 102. The lower cooling water supply pipe 110 is fixedly mounted on a support frame 114 and whereby support the upper cooling water supply pipe 108 and the upper slit laminar flow nozzle 100 through the vertical pipes 112.

On the other hand, the lower slit laminar flow nozzle 120 comprises a deformable flow guide plate 122 and a rigid flow guide plate 124. The flow guide plates 122 and 124 defines therebetween a slip gap 126. The upper end of the rigid flow guide plate 124 is pivotably secured to a bracket 128 of a base frame 130. The flow guide plate 124 is pivotable about a pivot 132 for allowing adjustment of the tilt angle of the slit laminar flow nozzle 120. The flow guide plate 124 is associated with a stopper pin 134 which is engageable with one of a plurality of stopper openings 136 formed through the base frame 130 to hold the flow guide plate 124 at selected tilt angle position.

On the other hand, the top edge of the flow guide plate 122 is rigidly secured to a cylindrical rotary pipe 136 which is rotatably supported on a frame angle 138 mounted on the base frame 130. By securing the top edge of the flow guide plate 122, resilient force biasing the flow guide plate 122 toward the flow guide plate 124 is variable depending on the angular position of the top edge relative to the rotary pipe 136. For allowing adjustment of the resilient force, the rotary pipe 136 is rotatably supported on the frame angle 138 for rotation about an axle 140. On the other hand, in order to hold the rotary pipe 136 at selected angular position, a stopper screw 142 is provided. The stopper screw 142 has an end contacting with the peripheral surface of the rotary pipe 136 to restrict rotation of the latter, at a locking position, On the other hand, the stopper screw 142 can be rotated to release the end from the rotary pipe 136 for allowing rotation of the latter while the angular position of the top edge of the flow guide plate 122 is to be adjusted for adjusting the resilient force.

In addition, the shown embodiment of the strip cooling system employs depressure bars 144 and 146. The depression bars 144 and 146 extend laterally and mate the flow guide plate 122 for exerting resilient force thereonto. The depression bars 144 and 146 are connected to piston rods 148 and 150 of air cylinders 152 and 154 which are pivotably secured to the base frame 130 through brackets 156 and 158. As set out with respect to the third embodiments, the air cylinders 152 and 152 provide resilient depressing force for resiliently limiting deformation and displacement of the flow guide plate 122. The resilient force created by the flow guide plate per se by securing the top edge to onto the rotary pipe 136 may cooperate with the depression force exerted through the depression bars 144 and 146 for restricting deformation and displacement of the flow guide plate 122.

Furthermore, the shown embodiment of the strip cooling system employs a pair of shutter members 160 and 162. Each shutter member 160 and 162 is of essentially U-shaped configration to define a gutter for draining the cooling water received therein. The shuuter members 160 and 162 are connected to tubes 164 and 166 for recirculating the cooling water to the cooling water reservoir or for draining.

Utilizing the aforementioned construction of the strip cooling system, experimentation is performed to find out best setting. The experimentation is performed for the cooling water flow rate of 170 $m^3$/hr. As a result of experimentation, the desirable slit laminar flow of the cooling water can be established through the slit laminar flow nozzle 120 when the flow guide plate 124 is set at tilt angle of 20° and depression force of 5 kg.f/m is exerted onto the flow guide plate 122 through the depression bars 144 and 146. The established laminar flow of the cooling water produce substantially no sprushing of the water upon contacting onto the steel strip surface. In the same condition, the cooling water flow rate is adjusted within a range of 50 $m^3$/hr. to 250 $m^3$/hr. No substantial change in the slit laminar flow established by the slit laminar flow nozzle 120 can be observed. This will be a good proof of that the strip cooling system according to the invention will provide substantially wide cooling water flow rate adjusting range without causing any defective change of the laminar flow condition.

Another experimentation is also performed by replacing the shutter members 160 and 162 with the flow control member 90 in the fourth embodiments. Response time in adjusting the cooling water supply rate and thus in adjusting the flow rate in the slit laminar flow established by the slit laminar flow nozzle 122 is checked. In the result, the error of the cooling water flow rate in the laminar flow is ±5% and response period is less than or equal to 1 sec. This will be satisfactorily for cooling the steel strip on a hot run table in a hot rolling line.

The preferred embodiments disclosed above employs a resiliently deformable plate for causing slight deformation of the plate to widen the cooling water path area at the lateral center of the slit laminar flow nozzle to provide slightly higher cooling efficiency than the other. This is advantageously employed for uniformity of the temperature distribution of the strip to be cooled. However, the capability of the deformation of the movable flow guide plate is not always required for formulating the present invention. Namely, rigid plate may be employed as movable flow guide plate for formulating modified embodiment of the strip cooling system according to the invention. Furthermore, in the shown embodiments, pipe laminar flow nozzles and slit laminar flow nozzles are employed as cooling water supply means for supplying cooling water to the slit laminar flow nozzles which establish the slit laminar flow for cooling the strip. However, the cooling water supply means is not necessarily the laminar flow nozzle but can be replaced any suitable means. Therefore, while the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A strip colling system comprising:

a laminar flow nozzle constituted of a pair of first and second plates arranged in side-by-side relationship to each other for defining therebetween a fluid path of a cooling fluid for establishing a slit laminar flow substantially perpendicular to a strip path, through which the strip is transferred, said first plate being displaceable relative to said second plate for varying the path area of said fluid path;

a cooling fluid supply means for supplying controlled amount of cooling fluid to flow through said fluid, path; and said first plate being responsive to fluid pressure within said fluid path, for causing displacement relative to said second plate at a magnitude corresponding to said fluid pressure.

2. A strip cooling system as set forth in claim 1, wherein said first plate is formed of a deformable material for causing deformtion corresponding the fluid pressure in said fluid path.

3. A strip cooling system as set forth in claim 1, wherein said cooling supply means comprises a laminar flow nozzle for supplying the cooling fuild at substantially uniform flow rate distribution over substantially overall width of said fluid path.

4. A strip cooling system as set forth in claim 1, wherein said first and second plates are arranged to define a minimum path area of said fluid path at an initial position, and said first plate is displaced away from said second plate at a magnitude corresponding the the fluid pressure in said fluid path for widening said path area.

5. A strip cooling system as set forth in claim 1, which further comprises a flow blocking means interposed between said cooling fluid supply means and said laminar flow nozzle for limiting cooling fluid path between said cooling fluid supply means and said laminar flow nozzle for adjusting cooling fluid supply rate for said laminar flow nozzle.

6. A strip cooling system as set forth in claim 5, wherein said flow blocking means is movable for adjusting flow blocking magnitude corresponding to the width of said strip to be cooled.

7. A strip cooling system as set forth in claim 6, wherein said flow blocking means comprises a pair of flow blocking members horizontally movable along the upper edge of said laminar flow nozzle for adjusting flow blocking magnitude.

8. A strip cooling system as set forth in claim 1, which further comprises a flow control means interposed between said cooling fluid supply means and said laminar flow nozzle for adjusting supply amount of said cooling fluid from said cooling water supply means to said laminar flow nozzle.

9. A strip cooling system as set forth in claim 8, wherein said flow control means is horizontally movable in a direction substantially parallel to the feed direction of said strip for adjusting limiting magnitude of cooling fluid supply according to desired cooling efficiency.

10. A strip cooling system as set forth in claim 9, wherein said flow control means intercepts part of cooling water supplied from said cooling water supply means for adjusting cooling water supply amount for said laminar flow nozzle.

11. A strip cooling system as set forth in claim 10, wherein said flow control means linearly increase and decrease intercepting amount of cooling water for linearly adjusting cooling fluid supply amount for said laminar flow nozzle.

12. A strip cooling system as set forth in claim 10, wherein said flow control means varies intercepting amount of said cooling fluid in stepwise fashion for adjusting cooling fluid supply amount in stepwise fashion.

13. A strip cooling system as set forth in claim 1, which further comprises means for biasing said first plate toward said second plate with a given force for limiting displacement of said first plate relative to said second plate in response to the fluid pressure within said fluid path.

14. A strip cooling system as set forth in claim 13, wherein said biasing means comprises a bar member extending substantially parallel to said first plate and an actuator depressing said bar member toward said first plate at a controlled pressure.

15. A strip cooling system as set forth in claim 1, wherein said first plate is made of a resiliently deformable materal and is fixed to a stationary member at the top edge thereof for creating resilient force in said first plate per se for resiliently biasing the same toward said second plate for restricting displacement of said first plate relative to said second plate.

16. A strip cooling system as set forth in claim 1, wherein said laminar flow nozzle is arranged oblique to a vertical plane, along which said cooling fluid is supplied from said cooling fluid supply means.

17. A strip cooling system as set forth in claim 16, which further comprises means for adjusting tilt angle of said laminar flow nozzle relative to said vertical plane.

18. A strip cooling system as set forth in claim 16, wherein said first plate is formed of a deformable material for causing deformtion corresponding the fluid pressure in said fluid path.

19. A strip cooling system as set forth in claim 16, wherein said cooing supply means comprises a laminar flow nozzle for supplying the cooling fuild at substtially uniform flow rate distribution over substantially overall width od said fluid path.

20. A strip cooling system as set forth in claim 16, wherein said first and second plates are arranged to define a minimum path area of said fluid path at an initial position, and said first plate is displaced away from said second plate at a magnitude corresponding the the fluid pressure in said fluid path for widening said path area.

21. A strip cooling system as set forth in claim 16, which further comprises a flow blocking means interposed between said cooling fluid supply means and said laminar flow nozzle for limiting cooling fluid path between said cooling fluid supply means and said laminar flow nozzle for adjusting cooling fluid supply rate for said laminar flow nozzle.

22. A strip cooling system as set forth in claim 21, wherein said flow blocking means is movable for adjusting flow blocking magnitude corresponding to the width of said strip to be cooled.

23. A strip cooling system as set forth in claim 22, wherein said flow blocking means comprises a pair of flow blocking members horizontally movable along the upper edge of said laminar flow nozzle for adjusting flow blocking magnitude.

24. A strip cooling system as set forth in claim 16, which further comprises a flow control means interposed between said cooling fluid supply means and said laminar flow nozzle for adjusting supply amount of said cooling fluid from said cooling water supply means to said laminar flow nozzle.

25. A strip cooling system as set forth in claim 24, wherein said flow control means is horizontally movable in a direction substaitoally parallel to the feed direction of said strip for adjusting limiting magnitude of cooling fluid supply according to desired cooling efficiency.

26. A strip cooling system as set forth in claim 25, wherein said flow control means intercepts part of cooling water supplied from said cooling water supply means for adjusting cooling water supply amount for said laminar flow nozzle.

27. A strip cooling system as set forth in claim 26, wherein said flow control means linearly increase and decrease intercepting amount of cooling water for linearly adjusting cooling fluid supply amount for said laminar flow nozzle.

28. A strip cooling system as set forth in claim 26, wherein said flow control means varies intercepting amount of said cooling fluid in stepwise fashion for adjusting cooling fluid supply amount in stepwise fashion.

29. A strip cooling system as set forth in claim 16, which further comprises means for biasing said first plate toward said second plate with a given force for limiting displacement of said first plate relative to said second plate in response to the fluid pressure within said fluid path.

30. A strip cooling system as set forth in claim 29, wherein said biasing means comprises a bar member extending substantially parallel to said first plate and an actuator depressing said bar member toward said first plate at a controlled pressure.

31. A strip cooling system as set forth in claim 16, wherein said first plate is made of a resiliently deformable materal and is fixed to a stationary member at the top edge thereof for creating resilient force in said first plate per se for resiliently biasing the same toward said second plate for restricting displacement of said first plate relative to said second plate.

32. A slit laminar flow nozzle for cooling an elongated strip transferred through a predetermined strip path, comprising:

a first and second plates arranged in side-by-side relationship to each other for defining therebetween a fluid path of a cooling fluid for establishing a slit laminar flow substantially perpendicular to a strip path, through which the strip is transferred; and means, responsive to fluid pressure within said fluid path, for causing displacement of said first plate relative to said second plate at a magnitude corresponding to said fluid pressure.

33. A slit laminar flow nozzle as set forth in claim 32, wherein said first and second plates are arranged to define a minimum path area of said fluid path at an initial position, and said first plate is displaced away from said second plate at a magnitude corresponding the the fluid pressure in said fluid path for widening said path area.

34. A slit laminar flow nozzle as set forth in claim 32, which further comprises a flow blocking means provided above the inlet of said laminar flow nozzle for limiting path area at said inlet for adjusting cooling fluid supply rate for said laminar flow nozzle.

35. A slit laminar flow nozzle as set forth in claim 34, wherein said flow blocking means is movable for adjusting flow blocking magnitude corresponding to the width of said strip to be cooled.

36. A slit laminar flow nozzle as set forth in claim 35, wherein said flow blocking means comprises a pair of flow blocking members horizontally movable along the upper edge of said laminar flow nozzle for adjusting flow blocking magnitude.

37. A slit laminar flow nozzle as set forth in claim 32, which further comprises a flow control means disposed above said laminar flow nozzle for adjusting supply amount of said cooling fluid, said flow control means is horizontally movable in a direction substantially parallel to the feed direction of said strip for adjusting limiting magnitude of cooling fluid supply according to desired cooling efficiency.

38. A slit laminar flow nozzle as set forth in claim 37, wherein said flow control means intercepts part of cooling water to be supplied to said laminar flow nozzle.

39. A slit laminar flow nozzle as set forth in claim 38, wherein said flow control means linearly increase and decrease intercepting amount of cooling water for linearly adjusting cooling fluid supply amount for said laminar flow nozzle.

40. A slit laminar flow nozzle as set forth in claim 39, wherein said flow control means varies intercepting amount of said cooling fluid in stepwise fashion for adjusting cooling fluid supply amount in stepwise fashion.

41. A slit laminar flow nozzle as set forth in claim 32, which further comprises means for biasing said first plate toward said second plate with a given force for limiting displacement of said first plate relative to said second plate in response to the fluid pressure within said fluid path.

42. A slit laminar flow nozzle as set forth in claim 41, wherein said biasing means comprises a bar member extending substantially parallel to said first plate and an actuator depressing said bar member toward said first plate at a controlled pressure.

43. A slit laminar flow nozzle as set forth in claim 32, wherein said first plate is made of a resiliently deformable materal and is fixed to a stationary member at the top edge thereof for creating resilient force in said first plate per se for resiliently biasing the same toward said second plate for restricting displacement of said first plate relative to said second plate.

44. A slit laminar flow nozzle as set forth in claim 32, wherein said laminar flow nozzle is arranged oblique to a vertical plane along which the cooling fluid is supplied.

45. A strip cooling system as set forth in claim 44, which further comprises means for adjusting tilt angle of said laminar flow nozzle relative to said vertical plane.

* * * * *